US006203688B1

(12) United States Patent
Lipsztajn et al.

(10) Patent No.: US 6,203,688 B1
(45) Date of Patent: Mar. 20, 2001

(54) ELECTROLYTIC PROCESS FOR PRODUCING CHLORINE DIOXIDE

(75) Inventors: Marek Lipsztajn, Etobicoke; Gerald Cowley, Mississauga, both of (CA); Jerry J. Kaczur, Cleveland, TN (US)

(73) Assignee: Sterling Pulp Chemicals, Ltd., Islington (CA)

( * ) Notice: Subject to any disclaimer, the term of this patent is extended or adjusted under 35 U.S.C. 154(b) by 0 days.

(21) Appl. No.: 09/173,032

(22) Filed: Oct. 16, 1998

Related U.S. Application Data

(60) Provisional application No. 60/062,521, filed on Oct. 17, 1997.

(51) Int. Cl.[7] ..... C25B 9/00
(52) U.S. Cl. ..... 205/556; 205/510
(58) Field of Search ..... 205/556, 510

(56) References Cited

U.S. PATENT DOCUMENTS

| | | | | |
|---|---|---|---|---|
| 2,163,793 | | 6/1939 | Logan . | |
| 2,717,237 | | 9/1955 | Rempel . | |
| 4,542,008 | | 9/1985 | Capuano et al. . | |
| 4,683,039 | | 7/1987 | Twardowski et al. . | |
| 5,041,196 | | 8/1991 | Cawlfield et al. . | |
| 5,084,149 | | 1/1992 | Kaczur et al. . | |
| 5,106,465 | | 4/1992 | Kaczur et al. . | |
| 5,158,658 | * | 10/1992 | Cawlfield et al. | 204/252 |
| 5,294,319 | | 3/1994 | Kaczur et al. . | |
| 5,298,280 | | 3/1994 | Kaczur et al. . | |

FOREIGN PATENT DOCUMENTS

| | | | |
|---|---|---|---|
| 2182127 | | 7/1996 | (CA) . |
| 714828 | * | 9/1954 | (GB) . |
| 56-158883 | | 12/1981 | (JP) . |
| 91/09158 | | 6/1991 | (WO) . |
| WO 91/09990 | | 7/1991 | (WO) . |
| WO 94/26670 | | 11/1994 | (WO) . |

OTHER PUBLICATIONS

The Chlorine Dioxide Handbook—Water Disinfection Series,—Donald F. Gates, pp. 86–87, No Date Available.

Kirk–Othmer—Encyclopedia of Chemical Technology—Fourth Ed. vol. 5, Carbon and Graphite Fibers to Chlorocarbons and Chlorohydrocarbons–$C_1$—p. 986. No Date Available.

* cited by examiner

*Primary Examiner*—Arun S. Phasge
(74) *Attorney, Agent, or Firm*—Sim & McBurney

(57) ABSTRACT

A process for converting in a single pass an aqueous alkaline pH, alkali metal chlorite solution into an aqueous chlorine dioxide-containing solution that involves the combination of (1) using an electrochemical acidification cell to lower the pH value of the aqueous alkali metal chlorite feed before it enters the anode compartment of an electrochemical oxidation cell where the chlorite is converted to chlorine dioxide with (2) using an anolyte flow pattern where the anolyte passes through a porous, high surface area electrode. This process results in a substantially improved conversion efficiency per pass.

23 Claims, 3 Drawing Sheets

ELECTROLYTIC PROCESS FOR PRODUCING CHLORINE DIOXIDE

This application claims benefit of provisional application 60/062,521 filed Oct. 17, 1997.

BACKGROUND OF THE INVENTION

1. Field of the Invention

The present invention is concerned with the electrolytic production of chlorine dioxide from chlorite ions. More particularly, the present invention relates to the electrochemical process and the electrolytic cell structure used to manufacture a high purity aqueous chlorine dioxide solution from a dilute aqueous alkali metal chlorite solution.

2. Description of the Art

It is known to produce chlorine dioxide electrolytically by the electro-oxidation of chlorite ions.

U.S. Pat. No. 2,163,793 describes an electrochemical chlorine dioxide generating process in which an aqueous solution of alkali metal chlorite and alkali metal chloride is electrolyzed in an electrolytic cell equipped with a porous diaphragm separating the anode and the cathode compartments.

British Patent No. 714,828 describes a process for the production of chlorine dioxide by electrolyzing an aqueous solution containing chlorite and a water-soluble salt of an inorganic oxy-acid other than sulfuric acid.

U.S. Pat. No. 2,717,237 discloses a method for producing chlorine dioxide by electrolysis of chlorite in the presence of a water-soluble alkali metal sulfate (e.g., sodium sulfate).

Japanese Patent Publication 81-158883, published Dec. 7, 1981, describes an electrolytic process for producing chlorine dioxide by electrolysis of chlorite in which the electrolyzed solution, at a pH of 2 or less, is fed to a stripping tank where air is introduced to recover the chlorine dioxide.

U.S. Pat. No. 4,542,008 describes an electrolytic process for chlorine dioxide production in which the sodium chlorite concentration of the solution leaving the anode compartment is measured by means of a photometric cell.

Published PCT International Patent Application WO 91/09158 and the corresponding U.S. Pat. No. 5,106,465 disclose a method of producing chlorine dioxide from alkali metal chlorite in an ion exchange compartment of a multi-compartment cell in which hydrogen ions generated in the anode compartment enter the ion exchange compartment through a cation exchange membrane, causing chlorite ion decomposition and forming chlorine dioxide.

PCT Published International Patent Application WO 94/26670 discloses a method of producing chlorine dioxide from sodium chlorite in which the gaseous product along with the water vapor is removed from the electrolyzed solution by means of a microporous, hydrophobic gas membrane. By removing water at the rate of its input to the anolyte, a continuous, environmentally innocuous operation with no undesired effluent can be effected.

While all the above mentioned patents and patent applications require the recirculation of the electrolyzed solution, PCT Published International Patent Application WO 91/09990 and its related U.S. Pat. Nos. (5,041,196, 5,084,149, 5,158,658, 5,298,280 and 5,294,319) teach an electrochemical process for producing chlorine dioxide from a dilute alkali metal chlorite solution in a single pass mode (i.e., with no recirculation of the anolyte) using a porous, high surface area anode. The product solution, in addition to chlorine dioxide, may also contain unconverted chlorite as well as undesired by-products, resulting from inefficiencies, such as chlorate or chloride ions.

The relative simplicity of the concept disclosed in WO 91/09990 and its related U.S. Patents makes it economically attractive. However, the presence of unconverted chlorite and undesired by-products in the product stream may preclude its use in many applications.

Therefore, there is a need for a chlorine dioxide generation process based on single pass mode with no recirculation of the anolyte wherein there is a high efficiency conversion of chlorite ions to chlorine dioxide per pass while minimizing the formation of undesired by-products.

BRIEF SUMMARY OF INVENTION

Surprisingly, it has been found that the combination of (1) using an electrochemical acidification cell to lower the pH value of the aqueous alkali metal chlorite feed to an optimum value before it enters the anode compartment of an electrochemical oxidation cell where the chlorite is converted to chlorine dioxide with (2) using an improved anolyte flow pattern in the electrochemical oxidation cell where the anolyte passes through a porous, high surface area electrode results in a substantially improved conversion efficiency per pass.

Accordingly, one aspect of the present invention is directed to a process for converting an aqueous, alkaline pH alkali metal chlorite solution to an aqueous chlorine dioxide-containing solution by:

(1) passing an aqueous, alkaline pH alkali metal chlorite solution through an electrochemical acidification cell having low surface area anode to produce an aqueous alkali metal chlorite solution having a pH less than 7; and then (2) passing the aqueous alkali metal chlorite solution with the pH less than 7 through a porous, high surface area electrode in the anode compartment of an electrochemical oxidation cell to convert at least a portion of said alkali metal chlorite to chlorine dioxide and to produce an aqueous chlorine dioxide-containing solution.

In one particular preferred embodiment, the anode compartment of the electrochemical oxidation cell has a flow gap region between the porous high surface area electrode and the separator means (e.g., a membrane) that separates the anode compartment from the cathode compartment. The acidified alkali metal chlorite solution enters the anode compartment through the flow gap region and flows through the porous, high surface area anode, and exits the anode compartment on the backside of the anode and out the anode compartment.

In another preferred embodiment, the porous high surface anode occupies substantially all of the anode compartment and the acidified alkali metal chlorite enters the bottom of the anode compartment and passes upwardly through the porous high surface area anode and exits at the top of the anode compartment.

In another preferred embodiment of the present invention, the aqueous chlorine dioxide-containing solution is passed through a chlorine dioxide stripper or removal apparatus (e.g., a membrane based separation unit) to separate chlorine dioxide gas from the aqueous solution.

BRIEF DESCRIPTION OF THE DRAWINGS

The invention will be more fully understood from the following detailed description taken in conjunction with the accompanying drawings in which.

DETAILED DESCRIPTION OF PREFERRED EMBODIMENTS

Figure 1:
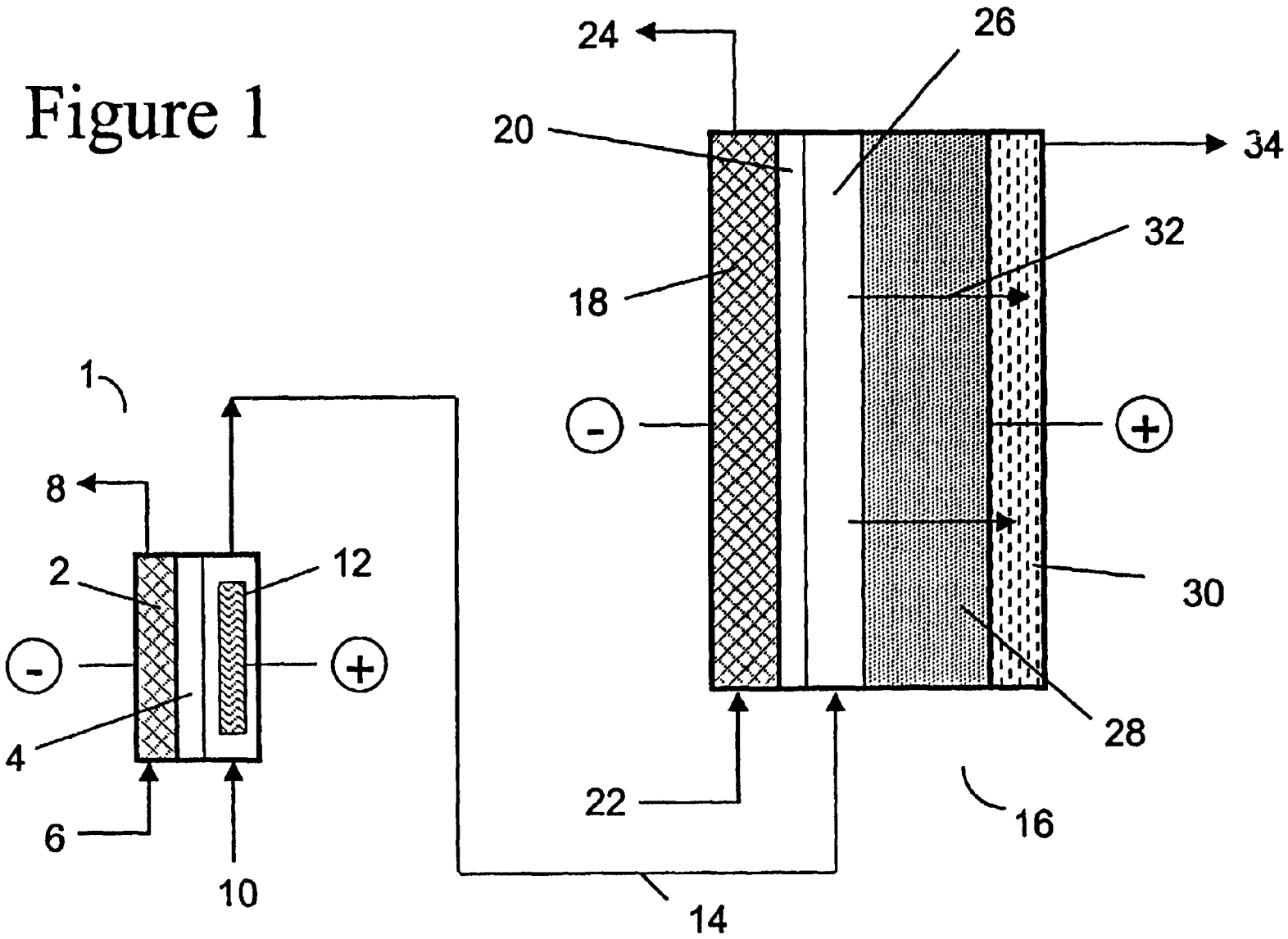
FIG. 1 is a flow diagram of a preferred embodiment of the present process involving a two-compartment electrochemical acidification cell and a two-compartment electrochemical oxidation cell having a finite gap between a membrane separator and the porous high surface area anode.

The aqueous, alkaline pH alkali metal chlorite solution employed as the starting material of present invention may include sodium chlorite, potassium chlorite, lithium chlorite and mixtures thereof. Sodium chlorite is most preferred. The aqueous, alkaline pH alkali metal chlorite solution will generally have pH in the range of from about 7 to about 13. This chlorite feed solution may optionally contain additives, activators or conductive salts. Suitable additives, activators or conductive salts include inorganic alkali metal salts such as chlorides, phosphates, sulfates, nitrates, nitrites, carbonates, borates and the like, as well as organic alkali metal salts including tartrates, citrates, acetates, formates, oxalates, gluconates, phthalates, benzoates and salicylates. Mixtures of these additives or activators such as alkali metal chlorides and alkali metal phosphates or tartrates may be used. Potassium, sodium and lithium are suitable alkali metal ions for these additives or activators, with the preferred alkali metal ions for these additives or activators being the same as the alkali metal ion for the chlorite employed.

Generally, the amount of alkali metal chlorite in the aqueous feed solution to the electrochemical oxidation cell will be in the range from about 0.1–150 grams per liter; more preferably from about 0.2–100 grams per liter; and most preferably, from about 0.5–50 grams per liter.

In order to simplify the present disclosure, the process of the present invention will be described using sodium chlorite, which is the preferred embodiment of the alkali metal chlorites.

The first step of the present invention is passing an aqueous alkaline pH sodium chlorite solution through an electrochemical acidification cell. Commercial sodium chlorite solutions are alkaline in order to maintain solution stability, i.e., to not generate chlorine dioxide during storage. If desired, the function of the acidification cell can be effected by an acid addition, typically sulfuric acid, phosphoric acid, acetic acid or hydrochloric acid. Acid salts such as bisulfate or dihydrogenphosphate can also be used, if desired.

This electrochemical acidification cell can be a two-compartment cell design having a single membrane separator or can be a three-compartment cell design using two membranes as given in U.S. Pat. No. 5,106,465. The purpose of the acidification cell is to minimize the occurrence of undesired reactions that lead to the formation of by-products, such as chlorate and chloride ions, as well as chlorine, in the electrochemical oxidation cell.

In the two-compartment cell design, the sodium chlorite feed is passed through the anolyte compartment and the solution is electrochemically acidified from the hydrogen ions produced from the oxidation of water at the anode (which produces oxygen and $H^+$ ions). Sodium ions ($Na^+$) are transferred through the cation ion exchange membrane and into the catholyte compartment. The cathode reaction in the catholyte compartment is preferably the reduction of water to produce hydroxyl ions ($OH^-$) and hydrogen. Sodium ions ($Na^+$) from the anolyte compartment are transferred through the cation ion exchange membrane and combine with the hydroxyl ions formed to produce NaOH. Preferably, the cell anode area is sized so as to operate at a high enough current density so that the predominant anode reaction is the oxidation of water and not the direct oxidation of sodium chlorite. The operating current density for this reaction is about 2 $kA/m^2$ and greater.

The applied cell current is used to acidify the alkaline sodium chlorite feed to an optimum pH range from about 2 to 7, and more preferably a pH range of about 2.5 to 6 before it enters the electrochemical oxidation cell (also sometimes referred to as an electrolyzer) so that the efficiency of that electrolyzer oxidation of sodium chlorite to chlorine dioxide is maximized and less by-products are formed, in particular sodium chlorate.

Suitable electrodes for the acidification cell preferably have electrocatalytic coatings consisting of a platinum group metal and/or a platinum group metal oxide coatings consisting of singly or mixtures of the platinum group elements of Ru, Rh, Pd, Ag, Os, Ir, Pt and Au. These anode coatings can also contain one or more additives in the formation of the electrocatalytic coatings from a group of elements including Ti, Ta, Zr, Y, Sr, Nb, Hf, Mo, Sn, Cr, V and W. In addition, the electrocatalytic suboxides of titanium, such as $Ti_4O_7$ or $Ti_5O_9$ known in the literature as EBONEX®, are also suitable as anode materials with or without electrocatalytic coatings applied to its surfaces. Preferably, the anode has an electrocatalytic coating that has a long term stability suitable in generating oxygen and hydrogen ions under both acidic conditions and in an alkaline pH range up to a pH of 12.

Preferred substrates for the anodes are Ti, Zr, Ta, and Nb in the pure metal forms and their common alloys with other elements.

Any suitable anode may be employed in the anode compartment, including those that are available commercially as dimensionally stable anodes. Preferably, an anode for the acidification cell is selected which will generate oxygen gas. These anodes include porous or high surface area anodes. As materials of construction metals or metal surfaces consisting of platinum gold, palladium, or mixtures or alloys thereof, or thin coatings of such materials on various substrates such as valve metals, i.e., titanium, can be used. Additionally, precious metals and oxides of iridium, rhodium or ruthenium, and alloys with other platinum group metals could also be employed. Commercially available anodes of this type include those manufactured by Englehard (PMCA 1500) or Eltech (TIR-2000). Other suitable anode materials may include graphite, graphite felt, a multiple layered graphite cloth, a graphite cloth weave, carbon, and the like. A thin deposited platinum conductive coating or layer on a corrosion resistant high surface area ceramic, or high surface area titanium fiber structure, or plastic fiber substrate could also be used. Examples of conductive stable ceramic electrodes are those sold by Ebonex Technologies, Inc. under the trade name Ebonex®.

The catholyte can be any suitable aqueous solution, including alkali metal chlorides or alkali metal sulfates, and any appropriate acids such as hydrochloric acid, sulfuric acid, phosphoric acid, nitric acid, acetic acid or other acids known in the art. Mixtures of salts and acids can also be used, if desired. In a preferred embodiment, ionized or softened water or sodium hydroxide solution is used as the catholyte in the cathode compartment to produce a chloride-free alkali metal hydroxide. The water selection is dependent on the desired purity of the alkali metal hydroxide by-product. The cathode compartment may also contain a strong acid cation exchange resin.

Any suitable cathode that generates hydrogen gas may be used in the electrochemical acidification cell, including, for example, those based on nickel or its alloys, including nickel-chrome based alloys; steel, including stainless steel; tantalum, tin, titanium, zirconium, iron, copper, other transition metals and alloys thereof. Precious metals, such as gold and silver, preferably in the form of coatings, could also be used. Additionally, a multiple layered graphite cloth, a graphite cloth weave, carbon, including felt structures of graphite or metals such as stainless steel could also be used. The cathode is preferably perforated or permeable to allow for suitable release of the hydrogen gas bubbles produced at the cathode particularly where the cathode is placed against the membrane. A spacer or a mesh, preferably made from any suitable plastic material, can be placed between the cathode and the membrane, if desired.

The generation of hydrogen ions in the process of the present invention in the anolyte compartment is accompanied, for example, by the oxidation of water on the anode into oxygen gas and $H^+$ ions by the electrode reaction as follows:

$$2H_2O \rightarrow O_2 + 4H^+ + 4e^-.$$

The acidified sodium chlorite solution is then passed into the anode compartment of the oxidation electrolyzer. The anolyte flow pattern in the anode compartment is a critical feature of the present invention. The anolyte must flow through the porous structure of the high-surface area electrode. Two particular flow patterns are preferred. One is the flow-through cell design electrolyzer system and the second is the zero gap design electrolyzer system. These are described as follows:

1. Flow-Through Cell Design Electrolyzer System

One preferred anolyte solution flow pattern involves directing the feed solution containing little or no chlorine dioxide into the anode compartment between the cation exchange membrane and a high surface area anode structure, then passing the anolyte through a high surface anode structure where the oxidation reaction of chlorite to chlorine dioxide takes place and directing the flow of the chlorine dioxide enriched anolyte away from the anode through the backside of the anode and out of the anode compartment.

The porous high surface area anode employed in the chlorine dioxide generation cell can be made from various high surface area electrode materials, preferably those disclosed in the aforementioned U.S. Pat. Nos. 5,041,196, 5,084,149, 5,158,658, 5,298,280, 5,294,319 and the published International Patent Application WO 94/26670, such as, for example, sintered or nonsintered platinized titanium fiber-based electrodes (sold by Olin Corporation under the Trademark TySAR®) or carbon cloth. The anode backplate employed in the chlorine dioxide generation cell can be made, for example, from a platinized titanium in the form of a perforated or expanded metal plate or a mesh.

Suitable cathodes for the flow-through design electrolyzer are as these described for the electrochemical acidification cell, including, for example, those based on nickel or its alloys, including nickel-chrome based alloys; steel, including stainless steel; tantalum, tin, titanium, zirconium, iron, copper, other transition metals and alloys thereof, precious metals, such as gold and silver, multiple layered graphite cloth, graphite cloth weave, carbon, including felt structures of graphite or metals such as stainless steel.

In order to minimize the cell voltage, the interelectrode gap should be kept to a minimum, especially with regard to the cathode compartment of the electrochemical cell. This can be achieved by employing a so-called zero gap cathode design.

Both the chlorine dioxide cell and the acidification cell can be operated as separate units or in a common module assembly. It is also possible to employ a single cell unit in which the anode comprises two segments: a low surface area part made from an oxygen evolving material, and a high surface area part in which the chlorine dioxide generation reaction takes place. The feed solution passes through the low surface area anode section to adjust the pH.

The anolyte feed solution typically contains no more than 30 gpL alkali metal chlorite (as sodium chlorite), preferably no more than about 20 gpL alkali metal chlorite (as sodium chlorite). It may optionally contain small quantities of other components, such as alkali metal chloride, sulfate, carbonate, bicarbonate similar to those described in U.S. Pat. No. 5,084,149.

These other components and additives can be either premixed with the chlorite feed and fed to the anolyte line before the acidification cell, or added separately after the acidification cell and before the chlorine dioxide generation cell.

The catholyte feed typically contains water, preferably free of undesired impurities such as hardness forming metal ions. Optionally the catholyte stream may be recirculated whereby the alkali metal hydroxide formed in the cathode compartment is either periodically or continuously withdrawn and directed to any suitable application.

The oxidation cell design has a finite gap (between about 0.001 inches to about 0.50 inches) between the membrane and the high surface area anode structure. The sodium chlorite feedstock is fed or directed into the gap region area, enters the high surface area anode electrode structure where it is efficiently converted to chlorine dioxide, and passes out through the other side of the anode and out of the cell. Alternatively, the sodium chlorite feedstock is fed into the anode compartment behind the porous high surface area anode structures and then passes through the porous electrode structure and exits the anode compartment from the gap region. The former flow pattern is preferred because the generated chloride dioxide does not generally come into contact with the membrane (and thereby form undesirable by-products, e.g., chlorates). The anode construction can be multi-layered using a composite construction using a fine high surface area layer top layer facing the membrane with correspondingly coarser materials deeper into the anode structure to provide stiffness, as well as flow and current distribution in the anode structure. The high surface area material is preferably made from fine fiber materials with or without electrocatalysts applied to the fiber surfaces depending on the electrochemical properties of the material, and provides the main surfaces where most if not almost 95% or more of the electrochemical oxidation takes place. The layer at the opposite end of the high surface area region can be a porous structural material such as perforated or expanded metal that can provide rigidity and good electrical current distribution for the anode structure. The coarser layers of the anode structure can be fabricated with or without electrocatalysts incorporated on their surfaces. The structure can be a sintered type structure where there is an adequate degree of the metallurgical bonding between the layers of the structure providing electrical paths through the entire structure from these metallurgical bonds. These bonds can also be made from spot welding the structure at numerous multiple points.

The anode structure can also be constructed using a nonsintered composite consisting of a nonsintered web layer of high surface area material that is in physical contact with a low or lower surface area material(s) such as perforated or expanded metal. In this case, if the base low surface area or current distributor electrode substrate materials is a valve metal, a stable electrocatalyst or conductive layer can be applied on the surfaces to provide a stable electrical contact surface to the non-sintered high surface area electrode layer. The contact force between the non-sintered layer and the current conductive layer can be by the force of the solution stream into the high surface layer forcing it against the current conductive layer or by the use of a mechanical means of pressing the non-sintered layer against the current conductive layer using a compressive screen, preferably non-conductive, in the gap area, mechanical ties or stitching means through the high surface area and into the current conductor material to pull and contact the materials together, and the like.

The gap region of the cell design may contain a screen or other device to separate or form the gap between the membrane and high surface area layer of the anode.

The electrochemical oxidation conversion of chlorite ions to chlorine dioxide in a single pass through the anode structure may range from about 1% to about 99%, and more preferably between 2% to 98%, and depends on the solution flow rate through the anode structure, the concentration of oxidizable chemical in solution stream, and the applied current to the anode structure.

2. Zero Gap Design Electrolyzer System

In this system, the cell design is identical to that in U.S. Pat. No. 5,041,196 where the cell is a zero gap type cell using a high surface area electrode structure and the solution feed is pre-acidified in the acidification cell and then fed into the zero gap cell. The conversion of sodium chlorite to chlorine dioxide as before is between 2% to about 99%, and more preferably between 5% and 98%.

The anode materials are preferably the same as in U.S. Pat. Nos. 5,294,319 and 5,298,280 with the preferred electrode material being a high surface area electrode made from fine titanium fibers coated having a platinum electrocatalyst coating on its surfaces.

Regardless of the anolyte flow pattern, the oxidation cell is operated at a current density of about 0.1 $kA/m^2$ to about 10 $kA/m^2$ with a more preferred range from about 0.2 $kA/m^2$ to about 5 $kA/m^2$. The constant operating cell voltage and the electrical resistance of the anolyte and catholyte solutions are limitations of the operating cell current density that must be traded off or balanced with current efficiency and the conversion yield of chlorite to chlorine dioxide.

Chlorine-free chlorine dioxide solutions produced by the process of the invention include those of a wide range of $ClO_2$ concentrations (gm/l), for example from about 0.1 to about 100 gm/l, with preferred chlorine dioxide solutions containing $ClO_2$ concentrations of from about 0.5 to about 80, and more preferably from about 1 to about 50 gm/l. As the concentration of $ClO_2$ increases, it is advisable to adjust process parameters such as the feed rate of the alkali metal chlorite solution and/or the current density to maintain the temperature of the ion exchange compartment within the more preferred temperature range as described above.

Where stronger chlorine dioxide product solutions are required, it is possible to obtain the desired product by using a higher concentration sodium chlorite feed solution of, for example, from about 50 to about 70 g/l in conjunction with an above atmospheric pressure in the cell 10. The higher pressure, from about 1.2 to about 5 atmospheres, is necessary to prevent the potentially explosive chlorine dioxide at concentrations of above about 50 g/l from coming out of solution to form a potentially explosive vapor phase.

The chlorine dioxide solutions produced by the process of the invention are removed from the oxidation cell having a pH in the range of from about 0.5 to about 6.5 and a temperature in the range of from about 20° C. to about 70° C.

Preferably, the chlorine dioxide solutions produced have substantially little or no residual chlorite concentration.

Where a chlorite residual concentration is present, passing the solution into a holding vessel to permit the reactions to go to completion may be desirable. Suitable holding vessels include pipes, tanks, and the like, which may have packing to increase the residence time and to prevent back mixing.

In one embodiment, the chlorine dioxide present in the solution produced by the process of the invention is converted to chlorine dioxide gas, for example, by sparging the solution with air or inert gas such as nitrogen, or by vacuum extraction. The remaining solution which may contain chlorate or residual chlorite ions can be fed to the cathode compartment of the electrolytic cell where these ions are electrochemically reduced to innocuous chloride ions in the catholyte solution which can be readily used in the process or disposed of by environmentally acceptable methods.

In a single pass system operating at conversions of at least 50%, and preferably 80% or greater, the chlorine dioxide product stream may be suitable for applications directly without a need for a stripping device to provide a pure chlorine dioxide product stream. In other applications, a high purity chlorine dioxide product may be required, and in this case, a stripping device may be employed. Suitable stripping devices may consist of gas or vacuum type stripping, where a motive gas or a vacuum is applied to the chlorine dioxide product stream from the electrochemical cell to remove a portion of the chlorine dioxide from that stream and pass it on to its intended application. Another type of device uses a gas permeable membrane device that allows the transport of chlorine dioxide from the electrolyzer chlorine dioxide product stream to a receiving stream that may be liquid or gas. This is disclosed in Sterling Pulp Chemical Patents and Patent Applications, for example, U.S. Pat. No. 4,683,039 or Canadian Patent Application No. 2,182,127 or the aforementioned PCT International Patent Application WO 94/26670.

U.S. Pat. No. 5,106,465, assigned to Olin Corporation, gives a chlorine dioxide stripping device that uses a motive gas or vacuum to strip the chlorine dioxide form the solution.

The single pass electrochemical cell operating at a high 90–99% conversion of chlorite to chlorine dioxide can have limitations in regard to the maximum cell operating current density. The maximum current density is determined by the feed concentration of sodium chlorite and the formation of the mahogany complex and the flowrate of the solution through the cell. In our experience, the feed concentration of the sodium chlorite is limited to about 30–40 g/l as sodium chlorite feed to the electrolyzer when operating in a single pass with a 90–99% conversion of chlorite to chlorine dioxide.

FIG. 1 shows a two-compartment electrochemical acidification cell 1 consisting of a cell having a cathode 2 in a catholyte compartment, anode 12 in an anolyte compartment, and a cation exchange membrane 4 separating the anolyte and catholyte compartments. Catholyte input stream 6 consisting preferably of deionized water or softened water flows into the catholyte compartment and exits the catholyte compartment as product effluent stream 8. Effluent product steam 8 consists of hydrogen gas and alkali metal hydroxide. The flow of the catholyte input stream 6 through the catholyte compartment can be in a single pass producing an alkali metal hydroxide product stream or effluent steam 8 can be recirculated back into catholyte input stream 6, with stream 8 producing a more concentrated alkali metal hydroxide end product solution. Anolyte input stream 10 consists of an alkali metal chlorite feed to the acidification cell 1 anolyte compartment containing anode 12, producing an acidified alkali metal chlorite solution and oxygen gas exiting as anolyte product stream 14. Acidification cell 1 can be constructed such that the cell is a zero gap type cell, where cathode 2 and anode 12 are in direct contact with membrane 4 in order to reduce the cell voltage. Alternatively, the cell may be constructed so that either cathode 2 or anode 12 is in contact with the membrane or both electrodes have a finite gap from the membrane.

Electrochemical oxidation cell 16 is a flow-through type cell design where the cell consisting of cathode 18 in a catholyte compartment, high surface area anode 28 in an anolyte compartment, and cation exchange membrane 20 separating the anolyte and catholyte compartments. The anolyte compartment also contains a finite gap or flow gap region 26 between membrane 20 and high surface area anode 28 that may contain a perforated or open mesh plastic spacer to maintain the finite gap. The anolyte compartment also contains a liquid/gas disengagement zone 30 that may also contain a perforated or open mesh plastic spacer. High surface area anode 28 may contain a current distributor (not shown) in its structure to help distribute current into the high surface area anode material. Anolyte input stream 22 consisting preferably of deionized water or softened water flows into the catholyte compartment containing cathode 18 and exits the catholyte compartment as product effluent stream 24. Effluent product stream 24 consists of hydrogen gas and alkali metal hydroxide. Acidified alkali metal chlorite anolyte product stream 14 from acidification cell 1 is fed into the anolyte compartment finite gap 26 region and then flows through high surface area anode 32 as shown by the line 32 into disengagement zone 30, and then exits as product output stream 34 as a chlorine dioxide containing solution product. Cathode 18 in the catholyte compartment can be assembled such that it is in contact with membrane 20 to have a zero gap cathode to reduce cell voltage or that there is a finite gap present.

Figure 2:
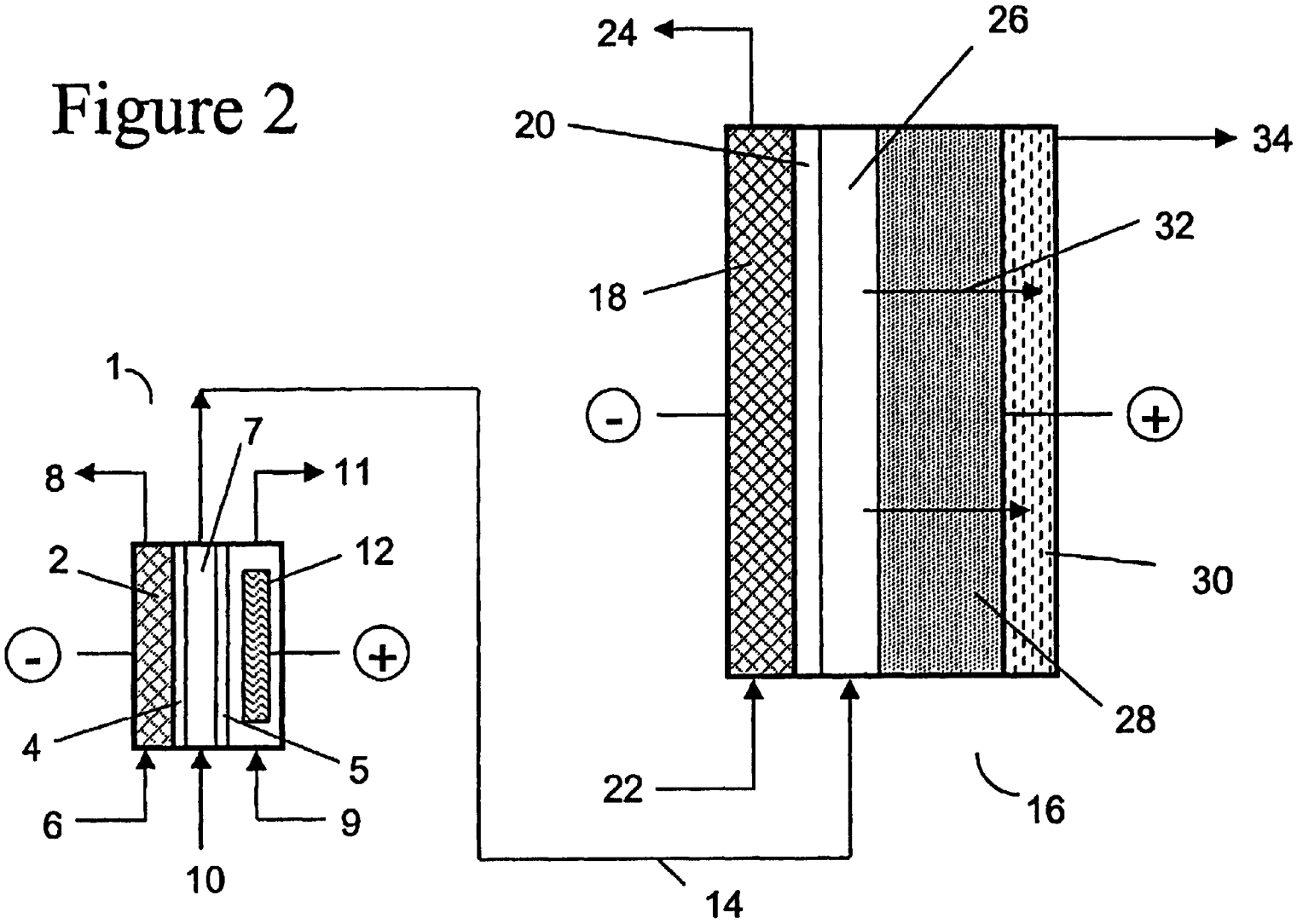
FIG. 2 is a flow diagram of another preferred embodiment of the present invention involving a three-compartment electrochemical acidification cell and a two-compartment electrochemical cell having a finite gap between a membrane separator and the porous high surface area anode.

FIG. 2 shows an alternate three-compartment acidification cell 1 configuration where two cation membranes, 4 and 5, are used to form a central ion exchanging compartment 7 where alkali metal chlorite stream 10 can be fed upflow and exits as an acidified product effluent stream 14 to electrochemical oxidation cell 16. In this configuration, the alkali metal chlorite feed solution is not in contact with an anode, and can potentially minimize or prevent any side anodic oxidation reactions with the chemical components in feedstock stream 10. The electrochemical acidification cell 1 is preferably arranged in a zero gap configuration with anode 12 and cathode 2 in contact with membranes 5 and 4 respectively. Alternatively, either anode 12 or cathode 2 or both can be operated with a finite gap with the adjacent membranes.

Figure 3:
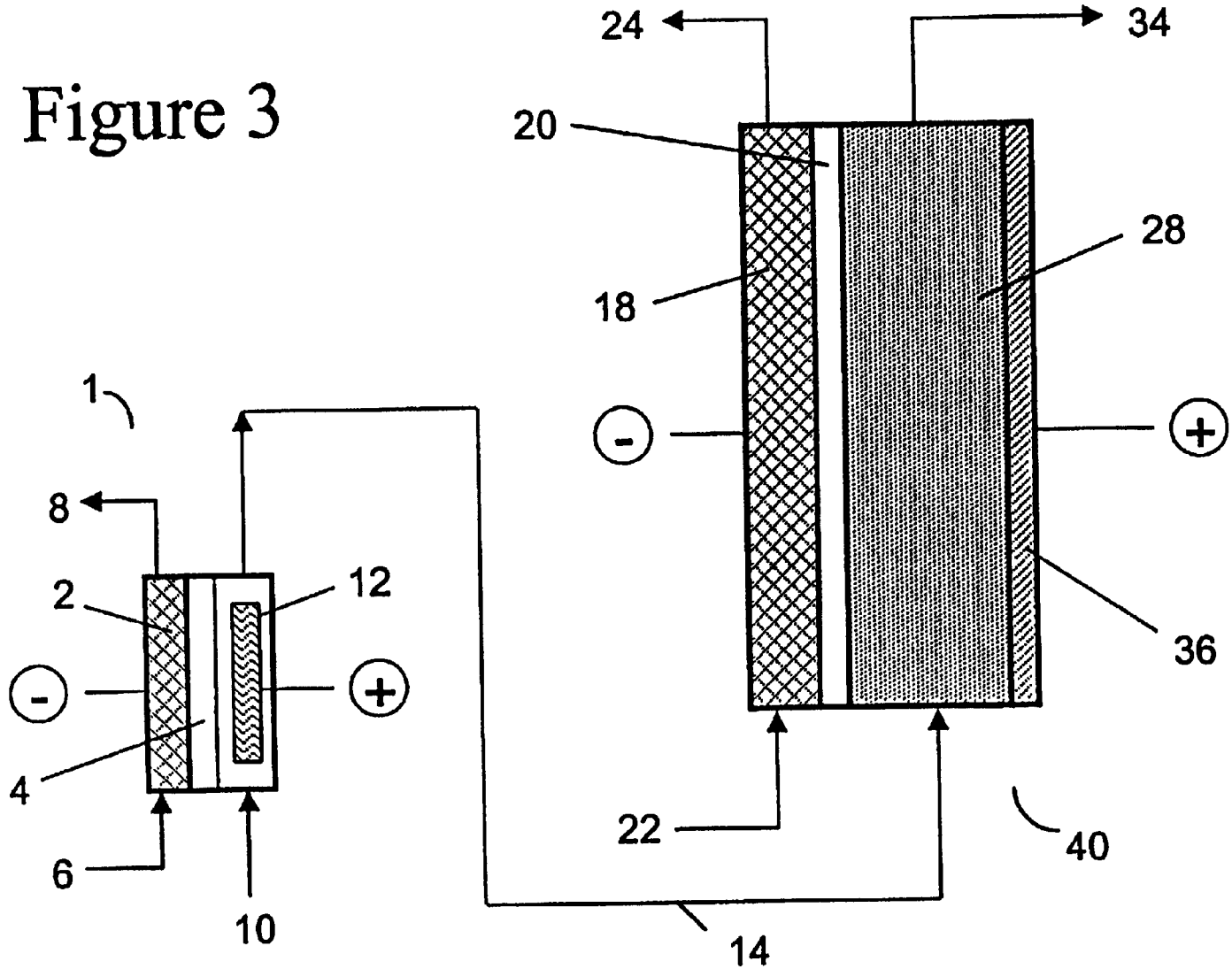
FIG. 3 is a flow diagram of a preferred embodiment of the present process involving a two-compartment electrochemical acidification cell and a two-compartment electrochemical oxidation cell having an anode and cathode zero gap design.

FIG. 3 shows a two-compartment acidification cell 1 and an alternative two-compartment electrochemical oxidation cell 40 in a configuration that preferably utilizes a zero gap anode and cathode design. The anolyte compartment contains current distributor 36 that distributes current into the high surface area anode 28. In this cell configuration, acidified alkali metal chlorite feed flow input stream 14 in the anolyte compartment runs parallel to membrane 20 and upward through cross sectional thickness of high surface area anode 28. Preferably, the high surface area anode fills the entire anolyte compartment between current distributor 36 and membrane 20 in the zero gap cell configuration. Alternatively, a spacer can be used between high surface area anode 28 and membrane 20. Cathode 18 is positioned directly against membrane 20 in a zero gap design or can alternatively have a spacer (not shown) positioned between cathode 18 and membrane 20.

EXAMPLE

A two-compartment electrochemical oxidation cell utilizing a zero gap anode and cathode design of the type denoted as 40 in FIG. 3 was employed to oxidize a sodium chlorite/sodium chloride mixture (the concentrations of $NaClO_2$ and NaCl were 9.74 gpL and 10.0 gpL, respectively) in a single pass through the zero gap anode/cathode design electrolyzer. The projected membrane or electrode surface area was 232 $cm^2$. The high surface area anode was manufactured from TySAR® WEP-12 material supplied by Olin Corporation. The anolyte flow rate was 30 ml/min.

The cathode compartment of the oxidizer was fed with 0.05 N NaOH at a flow rate of 20 ml/min. A current density of 0.25 $kA/m^2$ was applied to the cell, resulting in a cell voltage of 3.4 V. In an experimental run involving pre-acidification of the chlorite feed to a pH of 2.65, the product stream contained 6.75 gpL $ClO_2$, 0.66 gpL $NaClO_3$ as well as 0.08 gpl unreacted $NaClO_2$. Based on the product stream composition, the conversion efficiency of $NaClO_2$ into $ClO_2$ was calculated as 93.6%.

In a comparative experiment carried out in the absence of feed pre-acidification wherein the pH of the feed solution was 11.6, the conversion efficiency of $NaClO_2$ into $ClO_2$ was 89.2%.

The above described experiments clearly illustrate the beneficial effect of the feed pre-acidification on the conversion efficiency.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims. All patent applications, patents, and other publications cited herein are incorporated by reference in their entirety.

What we claim is:

1. A process for converting an aqueous alkaline pH alkali metal chlorite solution into an aqueous chlorine dioxide-containing solution in a single pass by:

(1) acidifying an aqueous alkaline pH alkali metal chlorite solution to produce an aqueous acidified alkali metal chlorite solution having a pH less than 7; and then (2) passing the acidified aqueous alkali metal chlorite solution through a porous, high surface area electrode in the anode compartment of an electrochemical oxidation cell to convert at least a portion of said alkali metal chlorite to chlorine dioxide, and to produce an aqueous chlorine dioxide-containing solution.

2. The process of claim 1, wherein said anode compartment of the electrochemical oxidation cell has a flow gap region between the porous high surface area electrode and the means for separating the anode compartment from the cathode compartment of the cell, and wherein said acidified alkali metal chlorite solution enters the anode compartment through the flow gap region and flows through the porous, high surface area anode and exits the anode compartment on the backside of the anode and out the anode compartment.

3. The process of claim 2 wherein the gap is sized from about 0.001 to about 0.50 inches.

4. The process of claim 1, wherein the porous high surface anode occupies substantially all of the anode compartment and the acidified alkali metal chlorite solution enters the bottom of the anode compartment and flows upward through the porous high surface area anode and exits at the upper end of the anode compartment.

5. The process of claim 1 wherein the aqueous chlorine dioxide-containing solution is passed through a chlorine dioxide removal apparatus to separate chlorine dioxide gas from the aqueous solution and wherein the resulting chlorine dioxide-free solution is recycled to a cathode compartment of the electrochemical acidification cell.

6. The process of claim 1 wherein said aqueous alkaline pH alkali metal chlorite solution is an aqueous alkaline pH sodium chlorite solution.

7. The process of claim 1 wherein said aqueous alkaline pH alkali metal chlorite solution has a pH of about 7 to about 13.

8. The process of claim 7 wherein said aqueous alkaline pH alkali metal chlorite solution contains at least one additive, activator or conductive salt.

9. The process of claim 8 wherein said at least one additive, activator or conductive salt is an alkali metal chloride, phosphate, sulfate, nitrate, nitrite, carbonate, borate, tartrate, citrate, acetate, formate, oxalate, gluconate, phthalate, benzoate or salicylate.

10. The process of claim 9 wherein the alkali metal of said alkali metal chloride, phosphate, sulfate, nitrate, nitrite, carbonate, borate, tartrate, citrate, acetate, formate, oxalate, gluconate, phthalate, benzoate or salicylate is the same as the alkali metal of the alkali metal chlorite.

11. The process of claim 1 wherein said aqueous alkaline pH alkali metal chlorite solution has a concentration of about 0.1 to 150 gpl.

12. The process of claim 11 wherein the concentration is about 0.2 to 100 gpl.

13. The process of claim 12 wherein the concentration is about 0.5 to 50 gpl.

14. The process of claim 1 wherein said acidified alkali metal chlorite solution has a pH of about 2 to 7.

15. The process of claim 14 wherein said pH is about 2.5 to 6.

16. The process of claim 1 wherein, in said electrochemical oxidation cell, a current density of about 0.1 $kA/m^2$ to about 10 $kA/m^2$ is applied to the porous high surface area anode.

17. The process of claim 16 wherein the current density is about 0.2 to about 5 $kA/m^2$.

18. The process of claim 1 wherein the aqueous chlorine dioxide-containing solution has a pH in the range of about 0.5 to about 6.5 and a temperature of about 20° to about 70° C.

19. The process of claim 18 wherein said aqueous chlorine dioxide-containing solution has substantially no residual alkali metal chlorite content.

20. A process for converting an alkaline pH alkali metal chlorite solution into an aqueous chlorine dioxide-containing solution in a single pass by:

(1) acidifying an alkaline pH alkali metal chlorite solution by passing said aqueous alkaline pH alkali metal chlorite solution through an electrochemical acidification cell having a low surface area anode to produce an aqueous acidified alkali metal chlorite solution having a pH less than 7, and then (2) passing the acidified aqueous alkali metal chlorite solution through a porous, high surface area electrode in the anode compartment of an electrochemical oxidation cell to convert at least a portion of said alkali metal chlorite to chlorine dioxide, and to produce an aqueous chlorine dioxide-containing solution.

21. The process of claim 20 wherein said electrochemical acidification cell is two-compartment cell having a cation-exchange membrane separating the cell into an anode compartment and a cathode compartment and wherein said aqueous alkaline pH alkali metal chlorite solution is passed through the anolyte compartment and the solution is electrochemically acidified by hydrogen ions produced by oxidation of water at the anode, while alkali metal ions are transferred through the cation exchange membrane and combine with hydroxyl ions formed in the cathode compartment to produce alkali metal hydroxide.

22. The process of claim 21 wherein the anode current density is at least about 2 $kA/m^2$.

23. The process of claim 20 wherein said electrochemical acidification cell is a three-compartment cell having two cation exchange membranes defining an anode compartment, a central compartment and a cathode compartment and wherein said aqueous alkaline pH alkali metal chlorite solution is passed through the central compartment and an anolyte is passed through the anode compartment and the solution is acidified by hydrogen ions produced in the anode compartment by oxidation of water at the anode transferring through the cation exchange membrane separating the anode compartment from the central compartment, which alkali metal ions are transferred through the cation-exchange membrane separating the central compartment from the cathode compartment and combine with hydroxyl ions formed in the cathode compartment to produce alkali metal hydroxide.

* * * * *